US010086616B2

(12) United States Patent
Sugaya et al.

(10) Patent No.: US 10,086,616 B2
(45) Date of Patent: Oct. 2, 2018

(54) IMAGE FORMING APPARATUS AND QUALITY DETERMINATION METHOD

(71) Applicant: Konica Minolta, Inc., Tokyo (JP)

(72) Inventors: Toyoaki Sugaya, Hachioji (JP); Toshiyuki Mizutani, Hino (JP); Takashi Muramatsu, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/747,493

(22) PCT Filed: Jul. 22, 2016

(86) PCT No.: PCT/JP2016/071539

§ 371 (c)(1),
(2) Date: Jan. 25, 2018

(87) PCT Pub. No.: WO2017/018341

PCT Pub. Date: Feb. 2, 2017

(65) Prior Publication Data

US 2018/0207937 A1 Jul. 26, 2018

(30) Foreign Application Priority Data

Jul. 28, 2015 (JP) ..... 2015-148572

(51) Int. Cl.
*B41J 29/393* (2006.01)
*B41J 2/165* (2006.01)
(Continued)

(52) U.S. Cl.
CPC ..... *B41J 2/16579* (2013.01); *B41J 2/2139* (2013.01); *B41J 2/2146* (2013.01);
(Continued)

(58) Field of Classification Search
CPC .... B41J 2/16579; B41J 2/2139; B41J 2/2146; B41J 29/393
(Continued)

(56) References Cited

U.S. PATENT DOCUMENTS 7,334,859 B2 * 2/2008 Kojima ..... B41J 2/2139 347/19
7,514,114 B2 * 4/2009 Wong ..... B41J 29/393 347/14
(Continued)

FOREIGN PATENT DOCUMENTS

JP 2009172966 A 8/2009
WO 2007132726 11/2007

OTHER PUBLICATIONS

International Preliminary Report on Patentability dated Sep. 20, 2016 from corresponding International Patent Application No. PCT/JP2016/071539 and English translation.
(Continued)

*Primary Examiner* — An Do
(74) *Attorney, Agent, or Firm* — Lucas & Mercanti, LLP

(57) ABSTRACT

An image forming apparatus includes the following. A recorder applies a colorant to a recording medium in accordance with a recording operation of a plurality of recording devices. An image-formation controller instructs the recorder to form a combined image including a plurality of normal images and a test image on the recording medium, the normal image being laid out in a recording area on the recording medium. A reader reads the images formed on the recording medium. A failure detector detects a recording operation failure of any of the recording devices based on the test image read by the reader. A determiner determines the quality of each of the normal images based on the detected result of the recording operation failure by the failure detector and positional information on the images in the combined image.

17 Claims, 9 Drawing Sheets

(51) Int. Cl.
*B41J 2/21* (2006.01)
*B41J 29/46* (2006.01)

(52) U.S. Cl.
CPC ..... *B41J 29/393* (2013.01); *B41J 29/46* (2013.01); *B41J 2029/3935* (2013.01)

(58) Field of Classification Search
USPC ..... 347/5, 19
See application file for complete search history.

(56) References Cited

U.S. PATENT DOCUMENTS

| | | | | |
|---|---|---|---|---|
| 8,740,339 | B2 * | 6/2014 | Yamazaki | B41J 2/2139 347/13 |
| 9,174,475 | B2 * | 11/2015 | Ueshima | B41J 2/16579 |
| 2005/0046658 | A1 | 3/2005 | Kojima | |
| 2013/0329144 | A1 | 12/2013 | Fukasawa | |
| 2017/0066268 | A1 | 3/2017 | Kyoso | |

OTHER PUBLICATIONS

International Search Report dated Sep. 20, 2016 for PCT/JP2016/071539 and English translation.
Extended European Search Report issued in corresponding application 16830446.7 dated Jul. 18, 2018.

* cited by examiner

FRONT FACE
BACK FACE
P
P
Im1
Im2
Im3
Im4
Im5
Im6
Im7
Im8
e
e
e
e
E
E
E
E
60
60
60
60
60
60
60
60
X
Y

IMAGE FORMING APPARATUS AND QUALITY DETERMINATION METHOD

CROSS REFERENCE TO RELATED APPLICATION

This Application is a 371 of PCT/JP2016/071539 filed on Jul. 22, 2016, which, in turn, claimed the priority of Japanese Patent Application No. JP 2015-148572 filed on Jul. 28, 2015, both applications are incorporated herein by reference.

TECHNOLOGICAL FIELD

The present invention relates to an image forming apparatus and a method of determining quality.

BACKGROUND ART

One of the traditional image forming apparatuses is an inkjet recorder including a plurality of recording devices having nozzles that eject ink onto a recording medium to form an image on the recording medium. If the size of a normal image to be formed is smaller than that of a recording medium in such an inkjet recorder, multiple normal images are laid out on a single recording medium to efficiently form images. After the normal images are formed, the recording medium including these normal images is cut along the outlines of the images to produce multiple recording mediums each including a normal image.

In an inkjet recorder, recording operation failure (ink ejection failure of nozzles) of a recording device leads to a reduction in the quality of the formed image. A technique is known for inspecting the recording devices and detecting recording operation failure of a recording device.

For example, Patent Document 1 discloses a technique of forming a test image in the margins of a recording medium around a normal image area and reading and analyzing the test image to detect recording operation failure of a recording device. Reading such a test image formed on the same recording medium as a normal image and detecting recording operation failure of a recording device can quickly and accurately determine the quality of the normal image formed on the recording medium.

PRIOR ART DOCUMENT

Patent Document

Patent Document 1: Japanese Patent Application Laid-Open Publication No. 2009-172966

SUMMARY

Problems to be Solved by the Invention

Unfortunately, if recording operation failure of a recording device is detected from the read test image in the traditional technique, the entire normal image formed on the recording medium is determined to have unsatisfactory quality. Thus, in the case where multiple normal images are laid out on a single recording medium, all of the normal images on the recording medium are determined to have unsatisfactory quality even if some of the normal images are formed with satisfactory quality.

An object of the present invention is to provide an image forming apparatus and a method of determining quality that can readily and appropriately determine the quality of each normal image laid out on a single recording medium.

Means for Solving the Problem

To achieve at least one of the abovementioned objects, according to an aspect of the present invention, an image forming apparatus reflecting one aspect of the present invention includes, a recorder applying a colorant to a recording medium in accordance with a recording operation of a plurality of recording devices;

an image-formation controller instructing the recorder to form a combined image including a plurality of normal images and a test image on the recording medium, the normal image being laid out in a recording area on the recording medium;

a reader reading the images formed on the recording medium;

a failure detector detecting a recording operation failure of any of the recording devices based on the test image read by the reader; and a determiner determining the quality of each of the normal images based on the detected result of the recording operation failure by the failure detector and positional information on the images in the combined image.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

EMBODIMENT FOR CARRYING OUT THE INVENTION

Hereinafter, one or more embodiments of the present invention will be described with reference to the drawings. However, the scope of the invention is not limited to the disclosed embodiments.

An image forming apparatus and a method of determining quality according to an embodiment of the present invention will now be described with reference to the accompanying drawings.

Figure 1:
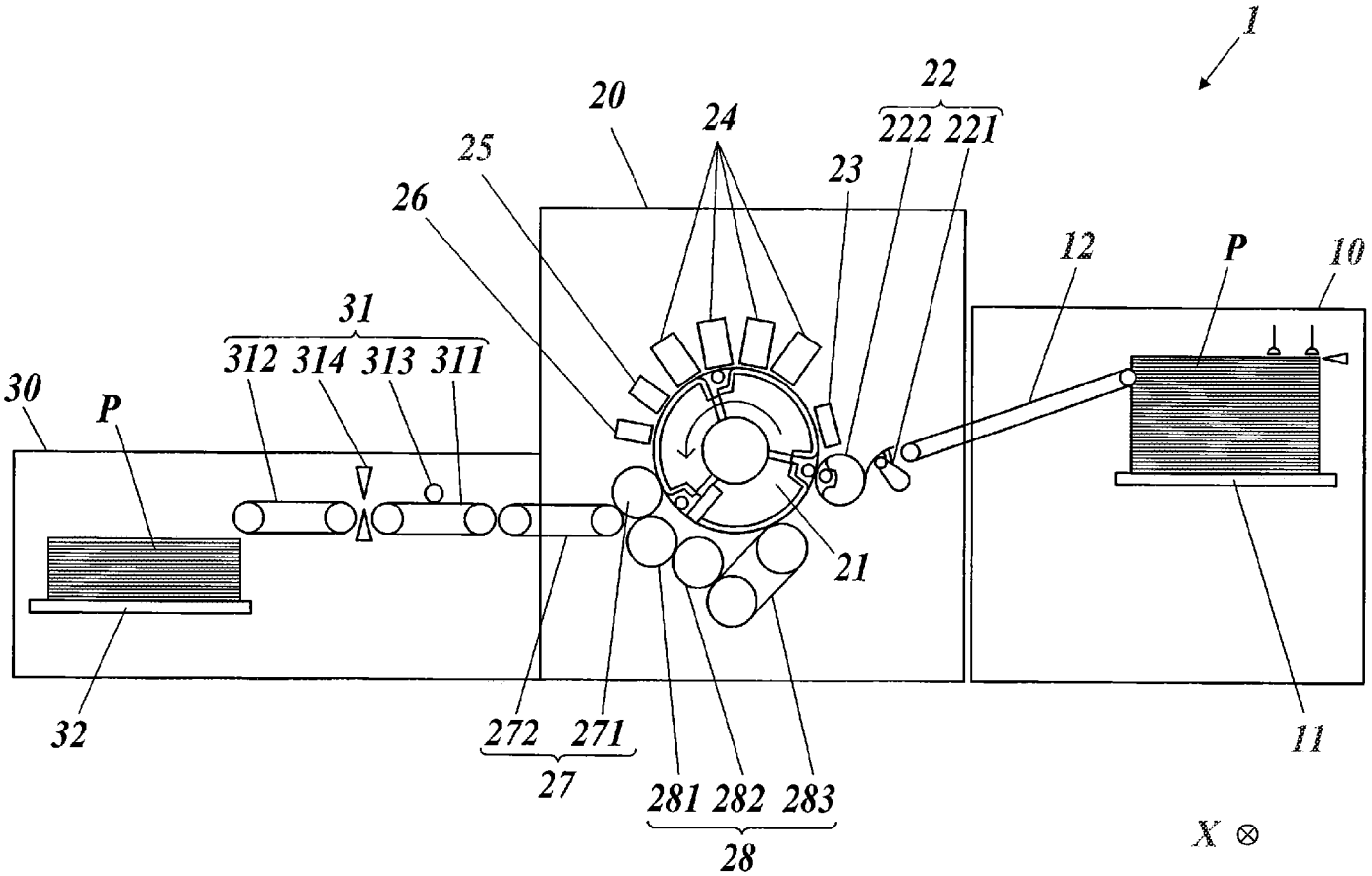
FIG. 1 is a schematic configurational view of an inkjet recorder according to an embodiment of the present invention.

FIG. 1 is a schematic configurational view of an inkjet recorder 1 according to an embodiment of the present invention.

Figure 3:
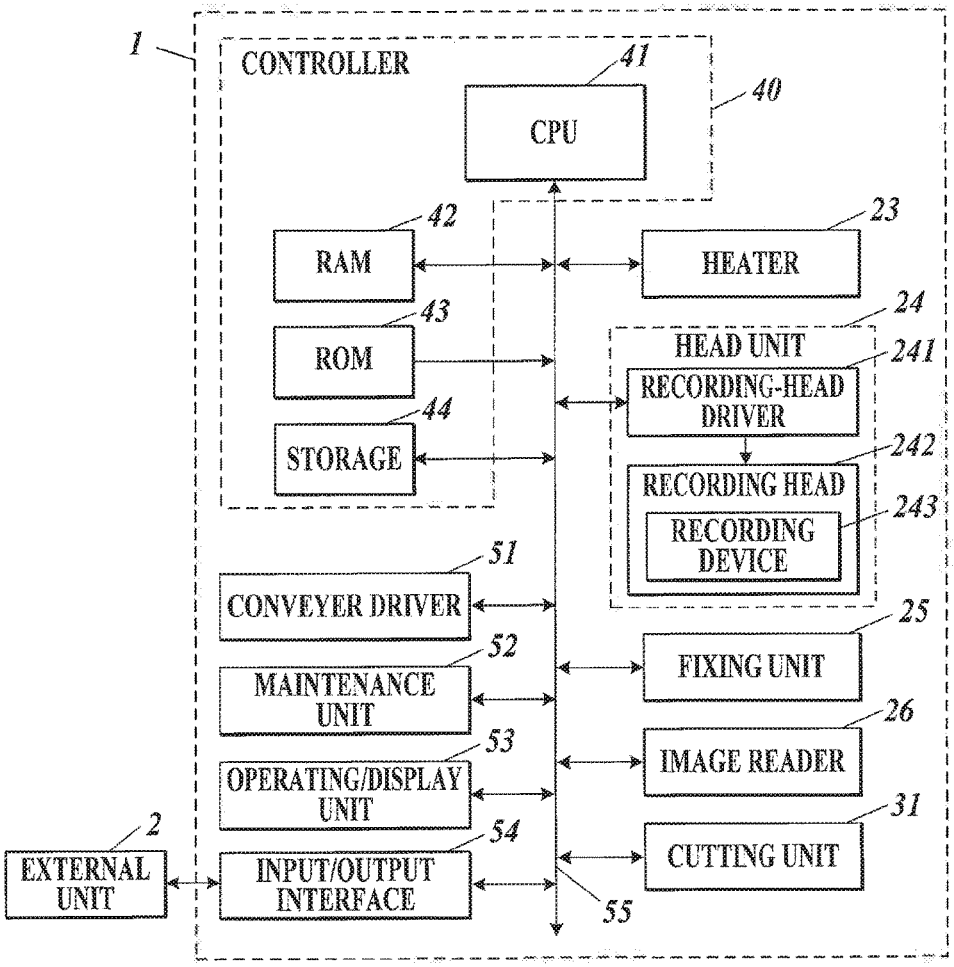
FIG. 3 is a block diagram of the essential functional configuration of the inkjet recorder.

The inkjet recorder 1 (image forming apparatus) includes a sheet feeder 10, an image recorder 20, a post-processor 30, and a controller 40 (FIG. 3). The inkjet recorder 1, under control of the controller 40, conveys a recording medium P stacked in the sheet feeder 10 to the image recorder 20, forms an image on the recording medium P at the image recorder 20, and conveys the recording medium P having the image to the post-processor 30 for cutting and ejection. The recording medium P may be any medium having a surface on which the ejected ink (colorant) can be fixed, such as paper (e.g., plain paper or coated paper), fabric, or a resin sheet.

The sheet feeder 10 includes a sheet tray 11 that stores the recording medium P and a sheet transfer unit 12 that conveys the recording medium P from the sheet tray 11 to the image recorder 20. The sheet transfer unit 12 includes an endless belt having an inner face supported by two rollers. The rollers are rotated while the recording medium P is placed on the outer face of the belt, to convey the recording medium P.

The image recorder 20 includes a conveyor drum 21 (shifting means), a transporter 22, a heater 23, head units 24 (recording means), a fixing unit 25, an image reader 26 (reading means), a delivery unit 27, and an inversion unit 28.

The conveyor drum 21 holds the recording medium P on its columnar outer periphery or conveying face and rotates around a rotary shaft extending in a direction (X direction) perpendicular to the drawing shown in FIG. 1 to convey the recording medium P in the conveying direction (Y or shifting direction) along the conveying face. The conveyor drum 21 includes a hook and an intake (not shown) for holding the recording medium P on the conveying face. The recording medium P is held at the edge by the hook and sucked to the conveying face by the intake.

The conveyor drum 21 is connected to a conveyor drum motor (not shown) that rotates the conveyor drum 21 and rotates by an angle proportional to the rotation of the conveyor drum motor.

The transporter 22 delivers the recording medium P conveyed by the sheet transfer unit 12 of the sheet feeder 10 into the conveyor drum 21. The transporter 22 is disposed between the sheet transfer unit 12 of the sheet feeder 10 and the conveyor drum 21. One edge of the recording medium P conveyed by the sheet transfer unit 12 is held by a swing arm 221 and transported to the conveyor drum 21 via a transport drum 222.

The heater 23 is disposed downstream of the transport drum 222 in the conveying direction and heats the recording medium P on the conveyor drum 21 to a temperature within a predetermined range. The heater 23 includes, for example, an infrared heater that generates heat in response to an input current supplied on the basis of control signals from a CPU 41 (FIG. 3).

The head units 24 eject ink onto the recording medium P in accordance with the rotation of the conveyor drum 21 holding the recording medium P, to form an image. The ink ejecting faces of the head units 24 face the conveyor drum 21 at a predetermined distance. In the inkjet recorder 1 according to this embodiment, four head units 24 corresponding to the yellow (Y), magenta (M), cyan (C), and black (K) colors are disposed in this order at predetermined intervals from upstream to downstream of the conveying direction of the recording medium P.

Figure 2:
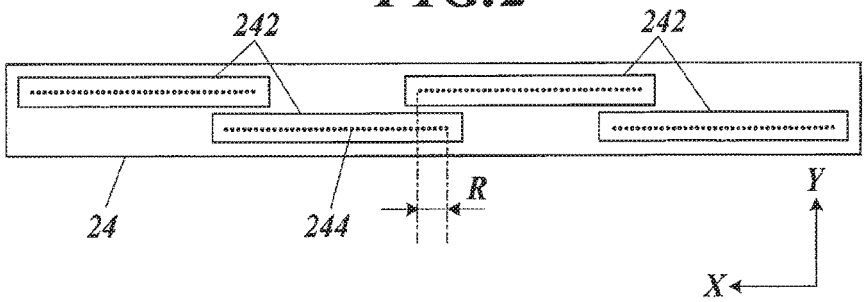
FIG. 2 is a schematic view of the configuration of a head unit.

FIG. 2 is a schematic view of the configuration of one of the head units 24. The drawing illustrates the face of the head unit 24 facing the conveying face of the conveyor drum 21.

Each head unit 24 includes four recording heads 242 having nozzles 244 of recording devices 243 (FIG. 3) arrayed in a direction intersecting the conveying direction of the recording medium P (the direction orthogonal to the conveying direction or the X direction in this embodiment).

The four recording heads 242 of the head unit 24 are staggered such that the recording heads 242 overlap in the X direction. The nozzles 244 of the first and third recording heads 242 and the nozzles 244 of the second and fourth recording heads 242 are aligned in the X direction. The nozzles 244 of adjacent recording heads 242 overlap along the X direction in the range R illustrated in FIG. 2, the range R being included in the area in which the adjacent recording heads 242 overlap in the X direction. For example, the nozzles 244 of only one of the two adjacent recording heads 242 in this range R are configured to eject ink.

The head unit 24 or line head unit includes nozzles 244 arrayed in the X direction across the width in the X direction in the region in which the image can be formed in the recording medium P conveyed by the conveyor drum 21. The head unit 24 is fixed relative to the conveyor drum 21 during formation of the image. That is, the inkjet recorder 1 is a single-pulse inkjet recorder. The nozzles 244 of the head unit 24 are arrayed at, for example, a pitch of 1200 dots per inch (dpi) in the X direction.

Alternatively, the recording heads 242 may have two or more arrays of the nozzles 244. For example, the recording heads 242 may include two arrays of the nozzles 244 in the X direction, the nozzles in each array being shifted relative to the nozzles in the other array by a distance equal to half of the pitch of the nozzles 244 in the X direction. Alternatively, the number of recording heads 242 of the head unit 24 may be equal to or less than 3 or equal to or more than 5.

The head unit 24 includes a recording-head driver 241 (FIG. 3) that drives the recording heads 242. The recording-head driver 241 includes a driving circuit that supplies voltage signals having a driving waveform corresponding to the image data to the recording heads 242 and a drive control circuit that sends image data to the driving circuit at appropriate timings.

The recording devices 243 of the recording heads 242 each include a pressure chamber storing ink, a piezoelectric device disposed on the sidewall of the pressure chamber, and a nozzle 244. Applying a voltage signal having a driving waveform for deforming the piezoelectric device from the driving circuit of the recording-head driver 241 to the piezoelectric device causes the pressure in the pressure chamber to vary in accordance with the voltage signal, causing an ink ejecting operation (recording operation) of the nozzle 244 in communication with the pressure chamber.

In some cases, the head unit 24 may include faulty recording devices 243 having ink ejection failure or recording operation failure due to a variation in production of the nozzles 244, characteristic variations of the piezoelectric devices, clogging of the nozzles 244, or blockage of the nozzle opening due to contamination.

The ink ejected from the recording heads 242 may be of any type that undergoes a phase transition between a gel and a sol depending on the temperature and cures in response to incident energy beams, such as ultraviolet rays.

The head unit 24 includes an ink heater (not shown). The ink heater operates under the control of the controller 40 to heat the ink stored in the head unit 24 to its solation temperature. The recording heads 242 eject the heated ink in a sol phase.

The fixing unit 25 includes a light emitter disposed across the width of the conveyor drum 21 in the X direction. The light emitter emits energy beams, such as ultraviolet rays, onto the recording medium P placed on the conveyor drum 21 to cure or fix the ink on the recording medium P. The light emitter of the fixing unit 25 is disposed downstream of the head units 24 in the conveying direction and faces the conveyor drum 21.

The image reader 26 faces the conveyor drum 21 at a position downstream of the position of fixing of ink by the fixing unit 25 in the conveying direction. The image reader 26 reads a predetermined area of the image on the recording medium P conveyed by the conveyor drum 21 and outputs image-capturing data of the image.

In this embodiment, the image reader 26 includes a light source that emits light toward the recording medium P conveyed by the conveyor drum 21 and a line sensor including imaging devices arrayed in the X direction to detect the intensity of the light reflected from the recording medium P. The line sensor can detect the image for each of the several wavelength components, such as the three wavelengths of the red (R), green (G), and blue (B) colors. The resolution of the image-capturing devices of the line sensor is, for example, 600 dpi in the width direction. That is, the image sensor may obtain the image at a resolution lower than the resolution corresponding to the pitch of the nozzles 244.

Besides the configuration of the image reader 26 described above, for example, an area sensor may be used in place of the line sensor.

The delivery unit 27 includes an endless belt 272 having an inner face supported by two rollers and a cylindrical transport drum 271 that transports the recording medium P from the conveyor drum 21 to the endless belt 272. The delivery unit 27 conveys the recording medium P transported from the conveyor drum 21 onto the endless belt 272 by the transport drum 271, to the post-processor 30.

The inversion unit 28 operates under the control of the CPU 41 to invert the front and back of the recording medium P transported from the transport drum 271 and transport the inverted recording medium P on the conveying face of the conveyor drum 21. The inversion unit 28 includes a first drum 281, a second drum 282, and an endless belt 283.

In the inversion unit 28, the recording medium P is transported from the transport drum 271 rotating clockwise in FIG. 1 to the first drum 281 rotating counterclockwise in FIG. 1. The recording medium P is then transported to the second drum 282 rotating clockwise in FIG. 1 and the endless belt 283 rotating counterclockwise, in this order. Upon the trailing edge of the recording medium P reaching near the nip between the second drum 282 and the endless belt 283, the rotating direction of the endless belt 283 is inverted to the clockwise direction in FIG. 1, such that the recording medium P is placed on the conveying face of the conveyor drum 21 at a position upstream of the transport drum 222 in the conveying direction. The recording medium P placed on the conveying face by the inversion unit 28 is again held by the conveyor drum 21 while the image face is in contact with the conveying face.

Besides the configuration of the inversion unit 28 described above, any other configuration may be selected that can invert the front and back face of the recording medium P and transport the recording medium P to the conveyor drum 21.

The post-processor 30 includes a cutting unit 31 that cuts the recording medium P ejected from the image recorder 20 through the delivery unit 27 and at least one flat sheet tray 32 on which the recording medium P cut by the cutting unit 31 is placed. The cutting unit 31 includes endless belts 311 and 312 that convey the recording medium P, a cutter 313 that cuts the recording medium P in the Y direction at a predetermined position in the X direction while the recording medium P is conveyed by the endless belt 311, and a cutter 314 that cuts the recording medium P at a predetermined position between the endless belts 311 and 312 in the X direction. The cutting unit 31 receives the results of the determined quality of the normal images formed on the recording medium P from the controller 40, cuts the recording medium P in accordance with the results, and conveys the cut sheets to the corresponding sheet tray 32. For example, the cutting unit 31 cuts the recording medium P and then ejects the cut sheets having images determined to be unsatisfactory quality and the cut sheets having images determined to be satisfactory quality into different sheet trays 32. If none of the images have satisfactory quality, the recording medium P is conveyed to the sheet tray 32 without cutting.

The post-processor 30 may include a bookbinder for binding the cut sheets of the recording medium P, if necessary.

FIG. 3 is a block diagram of the essential functional configuration of the inkjet recorder 1.

The inkjet recorder 1 includes a controller 40 including a central processor (CPU) 41 (image-formation controlling means, failure detecting means, determining means, faulty-recording-device identifying means, correction means, and recovery controlling means), a random access memory (RAM) 42, a read only memory (ROM) 43, and a storage 44 (memory means); a heater 23; a recording-head driver 241 driving the recording heads 242 of the head unit 24; a fixing unit 25; an image reader 26; a cutting unit 31; a conveyer driver 51; a maintenance unit 52 (recovery means); an operating/display unit 53; an input/output interface 54; and a bus 55.

The CPU 41 reads various control programs and data items stored in the ROM 43, stores the read programs and data in the RAM 42, and executes the programs to carry out various calculation processes. In this way, the CPU 41 comprehensively controls the overall operation of the inkjet recorder 1.

The RAM 42 provides a work memory space for the CPU 41 and temporarily stores data. The RAM 42 stores a maintenance flag indicating a status of a maintenance operation. The maintenance flag is binary data of one bit. The RAM 42 may include a non-volatile memory.

The ROM 43 stores various control programs and data items to be executed by the CPU 41. The data includes test image data on test patterns (test images) used for inspection of failure of ink ejection from the nozzles 244 of the recording devices 243 and defect identifying patterns (images for identification). Alternatively, a rewritable non-volatile memory, such as an electrically erasable programmable read only memory (EEPROM) or a flash memory, may be used in place of the ROM 43.

The storage 44 stores print jobs and image data associated with the print jobs input from an external unit 2 via the input/output interface 54. The image data is raster image data acquired through rasterization of vector image data. The rasterization may be carried out by the external unit 2, the controller 40 of the inkjet recorder 1, or an image processor (not shown) independent from the controller 40.

Some of the images corresponding to the image data associated with the print jobs according to this embodiment are normal images laid out without overlap with each other in one recording area of the recording medium P. The term "normal image" refers to an image to be formed on a recording medium P and excludes images used for inspection of ink ejection failure, such as test patterns and defect identifying patterns. It is preferred that the normal images be disposed apart from each other to facilitate cutting along the outlines of the normal images. Examples of such laid out normal images include images of the pages of a multi-page document and images of the developments of product packages.

The print jobs include positional data (positional information and information on quality determination areas) indicating quality determination areas of the normal images corresponding to the image data and cutting-position data indicating the positions of the recording medium P to be cut. The quality determination areas are defined to be areas of the normal images requiring appropriate image formation and are targets of the quality determination process for normal images described below. The term "appropriate image formation" refers to image formation carried out without a reduction in image quality due to ink ejection failure of a faulty recording device. The quality determination areas are usually defined by the outlines of the normal images. Alternatively, sections of the normal images may be selected depending on the use of the normal images. If a quality determination area corresponds to a rectangular pixel group having sides parallel to the direction of array of the pixels in the image data, the positional data may include the coordinates of the pixels at opposite vertices of the rectangle to indicate the quality determination area. Alternatively, the positional data may indicate the outlines of the quality determination area. Alternatively, image data for position identification including pixel arrays identical to those corresponding to the image data may be prepared, and different pixel values may be assigned to the pixels corresponding to the quality determination area and the pixels corresponding to other areas in the image data for position identification, to indicate the quality determination area.

The storage 44 stores positional data on faulty recording devices (faulty nozzles) determined to have ink ejection failure through inspection among the recording devices 243 in the head unit 24 and the parameters for compensation of the recording devices.

The storage 44 may be a hard disk drive (HDD) and may further include a dynamic random access memory (DRAM), for example.

The recording-head driver 241 instructs the recording heads 242 to eject ink on the basis of the control signals and the image data sent by the CPU 41. In specific, upon transmission of a control signal and image data by the CPU 41, the drive control circuit of the recording-head driver 241 instructs the driving circuit to output a voltage signal having a drive waveform to the piezoelectric devices of the recording devices 243 of the recording heads 242, to instruct the recording heads 242 to carry out an ejection operation of the ink from the nozzles 244 of the recording devices 243 by a volume corresponding to the image data, or a non-ejection operation of the ink when the image data corresponds to non-ejection or immediately before the subsequent recording operation after the previous recording operation.

The conveyer driver 51 sends a driving signal to the conveyor-drum motor of the conveyor drum 21 on the basis of the control signals from the CPU 41 to rotate the conveyor drum 21 at predetermined rate and timing. The conveyer driver 51 sends driving signals to the motors to operate the sheet transfer unit 12, the transporter 22, and the delivery unit 27 on the basis of the control signals from the CPU 41, to feed the recording medium P to the conveyor drum 21 or eject the recording medium P from the conveyor drum 21. The conveyer driver 51 operates the first drum 281, the second drum 282, and the endless belt 283 of the inversion unit 28 on the basis of the control signals from the CPU 41, to invert the front and back of the recording medium P by the inversion unit 28. The conveyer driver 51 operates the endless belts 311 and 312 of the cutting unit 31 on the basis of the control signals from the CPU 41, to convey the recording medium P in accordance with the operating timing of the cutters 313 and 314.

The maintenance unit 52 carries out a maintenance operation (recovery operation) to recover the ink ejection state of the faulty recording devices 243 of the head unit 24 that are recoverable to a normal state of ink ejection. The maintenance operation includes pressurized purging to force ejection of ink from the nozzles 244 of the head unit 24 to unclog the nozzles and wiping to clean the nozzle faces having the nozzles 244 of the head unit 24.

The maintenance unit 52 includes a pressurizing pump (not shown) that pressurizes ink at a predetermined pressurizing position in the ink supply channel in communication with the pressure chambers of the recording devices 243 during pressurized purging. The maintenance unit 52 further includes a cleaning roller (not shown) for wiping the nozzle faces. The cleaning roller is composed of, for example, a cylindrical member having an outer circumferential face wrapped around with a wiping cloth soaked with a predetermined solution.

The operating/display unit 53 includes a display, such as a liquid crystal display or an organic electroluminescent display, and an input unit including operating keys and a touch panel overlaid on the screen of the display. The operating/display unit 53 causes various information items to appear on the display, converts input operations to the input unit by the user to operating signals, and outputs the operating signals to the controller 40.

The input/output interface 54 communicates data with the external unit 2 and includes, for example, various serial interfaces, various parallel interfaces, or a combination of these interfaces.

The bus 55 is a channel for communication of signals between the controller 40 and other components.

The external unit 2 is, for example, a personal computer and sends information such as print jobs and image data to the controller 40 via the input/output interface 54.

Now will be described the determination of quality of multiple normal images on the basis of inspection of ink ejection failure of the recording devices 243 in the inkjet recorder 1 according to this embodiment and the results of the inspection.

The inkjet recorder 1 according to this embodiment carries out an inspection of ink ejection failure in the image forming process of each of the multiple normal images laid out in one recording area of the recording medium P. The inspection of ink ejection failure detects ink ejection failures on the basis of the results of reading of test patterns on the recording medium P by the image reader 26.

Figure 4:
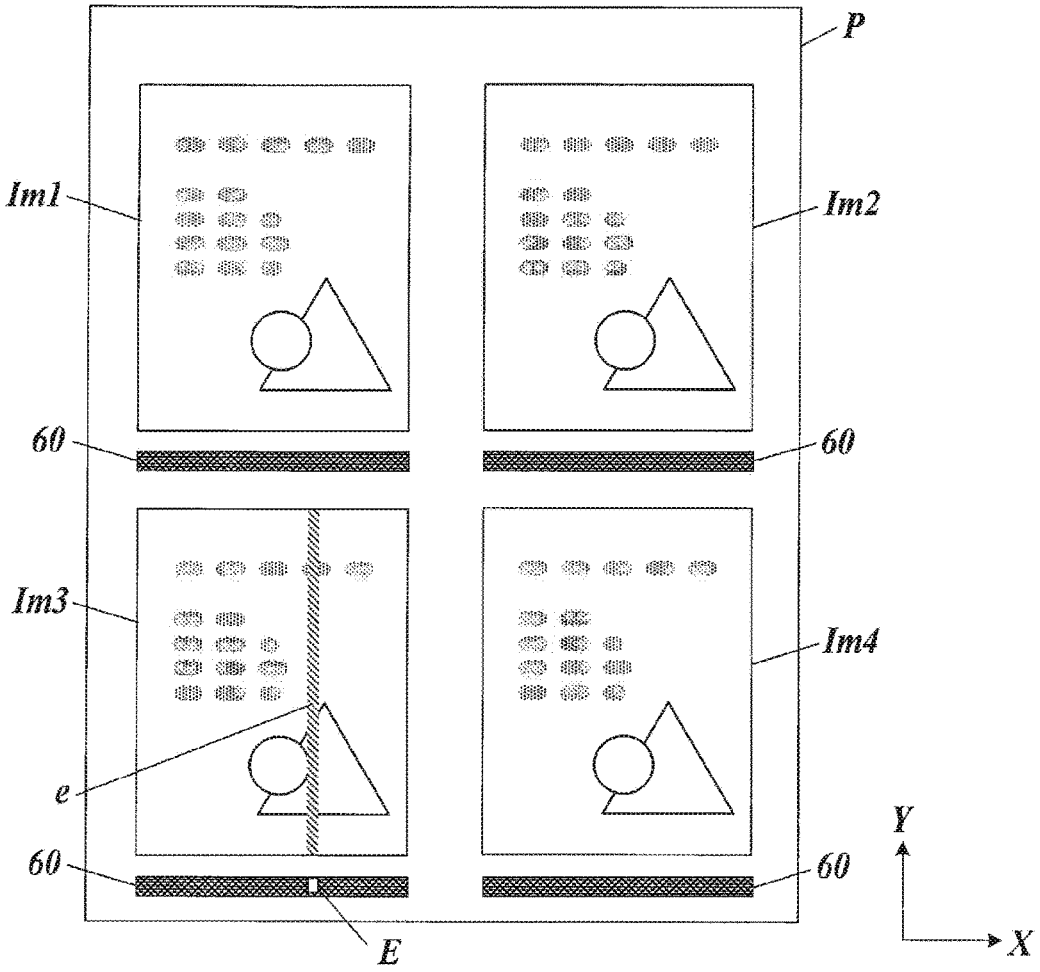
FIG. 4 illustrates example normal images and example test patterns formed on a recording medium.

FIG. 4 illustrates example normal images Im1 to Im4 and example test patterns 60 on the recording medium P. FIG. 4 illustrates the recording medium P having images formed by the head unit 24 and held on the conveyor drum 21. Hereinafter, a normal image Im refers to any of the normal images Im1 to Im4.

In FIG. 4, the four identical normal images Im1 to Im4 laid out in a 2 by 2 matrix in the X and Y directions are formed on the basis of the image data associated with a print job. After the formation of the four normal images Im1 to Im4, the outlines of the normal images Im1 to Im4 are cut by the cutting unit 31 to prepare recording sheets having the normal images Im1 to Im4.

The rectangular test patterns 60 extending in the width direction (X direction) orthogonal to the conveying direction are disposed in the margins of the normal images Im1 to Im4 in the −Y direction (toward the upstream of the conveying direction) such that the test patterns 60 correspond to the normal images Im1 to Im4. An image formed on the recording medium P including multiple normal images Im and test patterns 60, such as that illustrated in FIG. 4, is also referred to as a combined image.

Figure 5A:
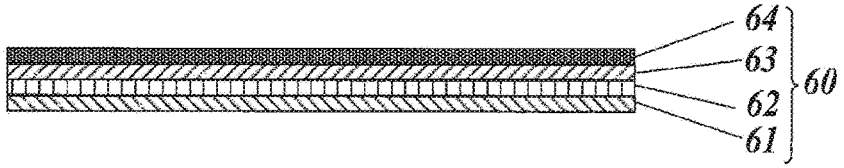
FIG. 5A is an enlarged view of a test pattern without ink ejection failure of a recording device.
Figure 5B:
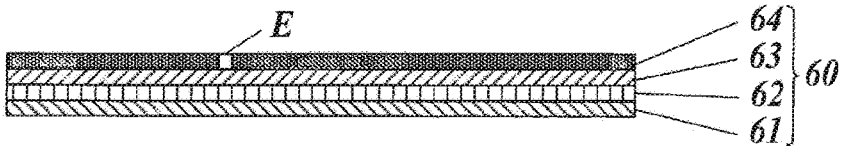
FIG. 5B is an enlarged view of a test pattern with ink ejection failure of a recording device.

FIGS. 5A and 5B are enlarged views of a test pattern 60. FIG. 5A illustrates a test pattern 60 without ink ejection failure of a recording device 243. FIG. 5B illustrates a test pattern 60 with ink ejection failure of a recording device 243.

With reference to FIG. 5A, the test pattern 60 includes color test sub-patterns 61 to 64 formed of ink of the YMCK colors. The color test sub-patterns 61 to 64 are images having readily recognizable darkness, for example, half-tone images of colors having constant concentrations.

The test pattern 60 has a length in the X direction equal to the length of the quality determination area of the corresponding normal image Im in the X direction. Specifically, the test pattern 60 and the quality determination area of the normal image Im corresponding to the test pattern 60 are formed by the recording devices 243 in the same region of the head unit 24. The quality determination areas in the normal images Im in FIG. 4 are the areas defined by the outlines of the normal images Im. The lengths of the test patterns 60 in the X direction are equal to the lengths of the respective normal images Im in the X direction.

The test patterns 60 can be appropriately formed in the margins of the normal images Im1 to Im4 on the recording medium P. The normal images Im1 to Im4 are disposed at predetermined intervals in the Y direction, so that the reading timing by the image reader 26 can be readily controlled and the operations involving reading and analysis of the test patterns 60 are readily carried out at appropriate time intervals corresponding to the conveying rate of the recording medium P.

The test patterns 60 are read by the image reader 26. The imaging data on the test patterns 60 by the image reader 26 is temporarily stored in the RAM 42 of the controller 40 and used for detection of faulty recording devices by the CPU 41 of the controller 40.

The controller 40 detects gradation (color unevenness) in the test patterns 60 in the imaging data. If the head unit 24 includes a faulty recording device that causes ink ejected from the nozzles 244 of the faulty recording device to have a reduced concentration at the ink landing site, an uneven color spot E appears in the corresponding test pattern 60, as illustrated in FIG. 5B. The uneven color spot E is detected in the imaging data on the test pattern 60 by the controller 40. As described above, the resolution of the line sensor of the image reader 26 is lower than that of the nozzle array. Thus, the faulty recording device causing the uneven color spot E is specified in a block including multiple recording devices 243 on the basis of the test pattern 60. Alternatively, only the presence of a faulty recording device may be determined.

The inkjet recorder 1 determines the quality of the normal images Im1 to Im4 by determining unsatisfactory quality of the normal image Im corresponding to the test pattern 60 including the detected uneven color spot E.

For example, if an uneven color spot E is detected in the test pattern 60 corresponding to the normal image Im3 among the four test patterns 60 illustrated in FIG. 4, at least a portion of the normal image Im3 includes an unsatisfactory region e due to ink ejection failure of a faulty recording device. Thus, the normal image Im3 corresponding to the test pattern 60 having the detected uneven color spot E is determined to have unsatisfactory quality. The other normal images Im1, Im2, and Im4 are determined to be appropriately formed. If ink is not ejected from a faulty recording device due to ink ejection failure, the unsatisfactory region e includes a visibly recognizable white streak. For simplicity, the unsatisfactory region e in FIG. 4 is represented as a hatched area (also in FIGS. 8 to 11).

It can be determined that since the test pattern 60 corresponding to the normal image Im1 does not include an uneven color spot E, the ink ejection failure causing the uneven color spot E in the test pattern 60 corresponding to the normal image Im3 occurs between the end of the formation of the test pattern 60 corresponding to the normal image Im1 and the start of the formation of the test pattern 60 corresponding to the normal image Im3. Thus, the normal image Im1 is determined to be appropriately formed because the test pattern 60 corresponding to the normal image Im1 does not have an uneven color spot E even though an uneven color spot is detected in the test pattern 60 corresponding to the normal image Im3. In this way, the test patterns 60 can be disposed at different positions in the Y direction corresponding to the normal images Im1 to Im4, such that the quality of the normal images Im disposed adjacent to each other in the Y direction can be independently determined.

If at least one of the normal images Im is determined to be appropriately formed, the recording medium P is cut by the cutting unit 31 to obtain recording sheets having appropriately formed normal images Im.

If an image is formed on the subsequent recording medium P after an uneven color spot E is detected in a test pattern 60 in the inspection of ink ejection failure described above, an unsatisfactory region e forms again due to the faulty recording device, unless the ink ejection failure of the faulty recording device is not recovered. Thus, if an uneven color spot E is detected in a test pattern 60, the inkjet recorder 1 carries out the following color-unevenness compensation.

In the color-unevenness compensation, defect identifying patterns for detecting ink ejection failure in each recording device 243 are output on one sheet of the recording medium P. The defect identifying patterns are read by the image reader 26 and analyzed by the controller 40 to determine the position of the ink defect and identify the faulty recording device.

The defect identifying patterns may be, for example, line patterns each consisting of multiple lines formed by ink ejected from the nozzles 244 of the recording devices 243 of the head unit 24. If the imaging data obtained through reading of this pattern includes a defective line or a line formed at an inappropriate position not corresponding to a nozzle 244 of a recording device 243, the recording device 243 corresponding to the line is identified as a faulty recording device.

In the case where a faulty recording device is identified, the parameters for compensation are established to prevent ejection of ink from the faulty recording device and increase the volume of ink ejected from the recording devices 243 in the vicinity of the faulty recording device in proportion to the volume of ink corresponding to the faulty recording device. The compensation process corrects the image data on the normal images Im and the test image data on the test patterns 60 so as to prevent ejection of ink from the faulty recording device and to increase the volume of ink to be ejected from the recording devices 243 in the vicinity of the faulty recording device in proportion to the volume of ink corresponding to the faulty recording device.

After the parameters for compensation are established, a re-formation operation is carried out to appropriately re-form the image that has been determined to have unsatisfactory quality among the normal images Im through the quality determination process on the new recording medium P. In the case where more than one normal image Im is determined to have unsatisfactory quality through the quality determination process of the normal images Im, all of the normal images Im determined to have unsatisfactory quality are re-formed on a new recording medium P.

If the detected recording operation failure fulfills a predetermined condition involving a reduction in quality of the formed image, e.g., if appropriate compensation cannot be achieved due to many recording devices being identified as faulty recording devices or consecutive faulty recording devices, the maintenance unit 52 carries out a maintenance operation to recover the faulty recording device to a normal state.

The pressurized purge in the maintenance operation is carried out by a pressurizing pump of the maintenance unit 52 pressurizing the ink at a predetermined pressurization position in the ink supply channel in communication with the pressure chamber of the recording device 243. The pressurization of the ink forces the ink to be ejected from the nozzles 244 of the recording device 243 to unclog the nozzles 244. The pressurized purging is carried out while a predetermined ink container is disposed underneath the nozzle face of the head unit 24.

Wiping in the maintenance operation is carried out by rotating the cleaning roller of the maintenance unit 52 in contact with the nozzle face of the head unit 24 while shifting the cleaning roller in the extending direction of the nozzle face. Wiping the entire nozzle face with a wiping cloth fixed to the outer circumferential face of the cleaning roller removes ink and foreign materials attached to the nozzle face and the openings of the nozzles 244.

After completion of the maintenance operation, the parameters of compensation are set again on the basis of the identification of the faulty recording device by the defect identifying patterns and the results of the identification. If the results indicate that appropriate compensation can be carried out, the re-formation operation continues. If appropriate compensation cannot be carried out, the operating/display unit 53 displays, for example, an error message promoting replacement of the head unit 24.

The control procedure carried out by the CPU 41 in the image forming process including the processes involving the inspection of ink ejection failure and the color-unevenness compensation will now be described.

Figure 6:
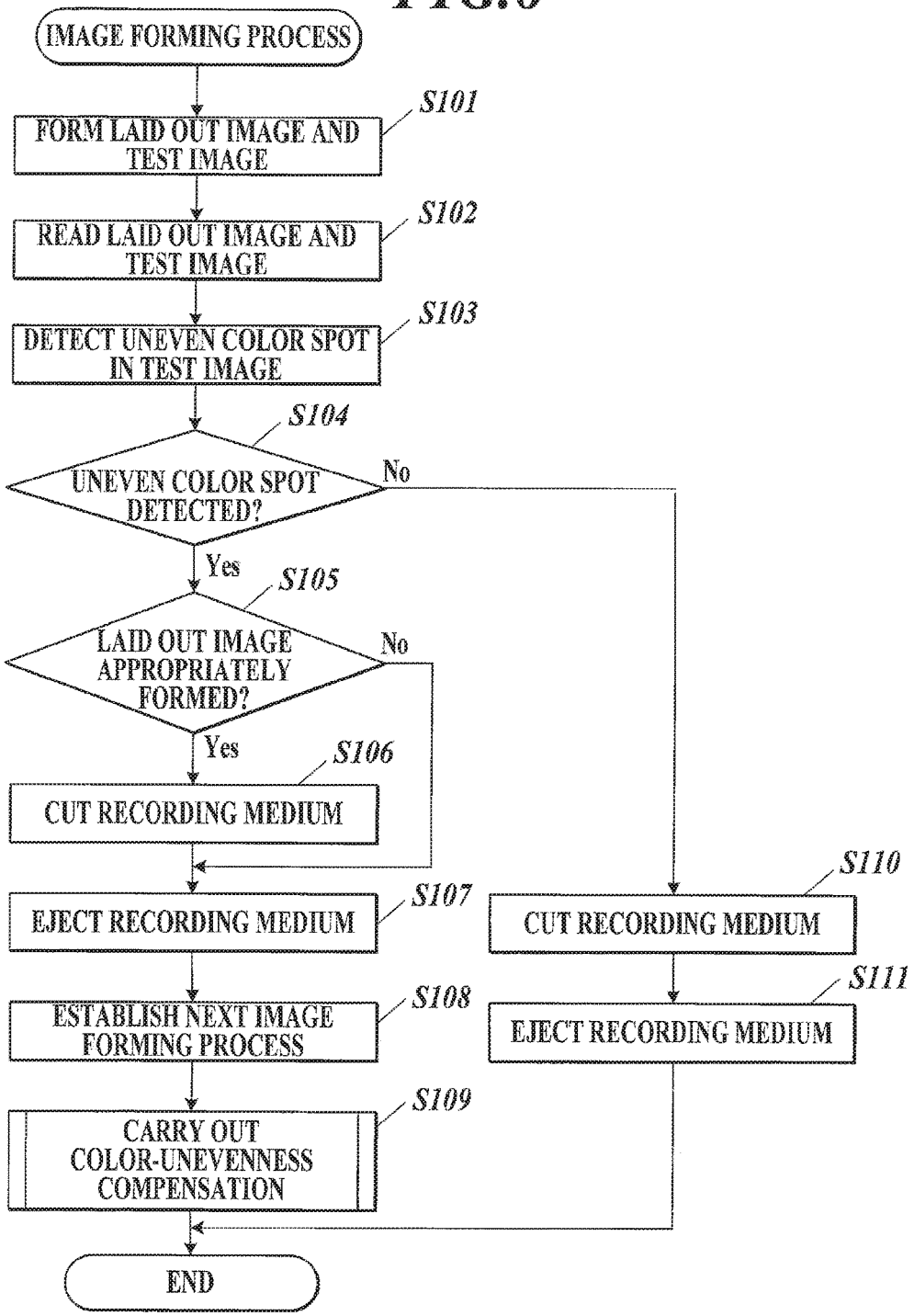
FIG. 6 is a flow chart illustrating the control procedure in an image forming process.

FIG. 6 is a flow chart illustrating the control process of the image forming process.

The image forming process is carried out, for example, in response to a print job and image data sent from the external unit 2 to the controller 40 via the input/output interface 54.

At the start of the image forming process, the CPU 41 instructs the head unit 24 to form an image on the basis of the image data (Step S101) (image forming step). In specific, the CPU 41 outputs a control signal to the conveyer driver 51 to instruct the conveyer driver 51 to rotate the conveyor drum 21 so as to convey the recording medium P. The CPU 41 sends image data and control signals to the recording-head driver 241 to instruct the recording-head driver 241 to output voltage signals having a drive waveform to the recording heads 242 at appropriate timings in accordance with the rotation of the conveyor drum 21. This causes the recording devices 243 of the head unit 24 to eject ink onto the recording medium P conveyed on the conveyor drum 21 and form normal images Im and test patterns 60 corresponding to these normal images Im on the recording medium P. The CPU 41 sends the image data on the normal images Im to the recording-head driver 241 at the timings of the formation of the normal images Im in accordance with the rotation of the conveyor drum 21 and the test image data on the test images to the recording-head driver 241 at the timings of the formation of the test patterns 60, to form the normal images Im and the test patterns 60 on the recording medium P. The CPU 41 forms each of the test patterns 60 with a length in the X direction equal to that of the normal images Im, with reference to the length of each of the normal images Im in the X direction indicated in the positional data of the print job.

The CPU 41 instructs the image reader 26 to repeatedly read the normal images Im and the test patterns 60 on the recording medium P at appropriate intervals while conveying the recording medium P on the conveyor drum 21, acquires imaging data, and stores this data in the storage 44 (step S102).

The CPU 41 detects an uneven color spot E in the imaging data on the test patterns 60 (step S103) (failure detecting step). The CPU 41 determines whether the test pattern 60 including the uneven color spot E is detected (step S104) (determining step).

If no uneven color spot E is detected in any of the test patterns 60 (NO in step S104), the CPU 41 outputs control signals to the conveyer driver 51 to convey the recording medium P by the endless belts 311 and 312 of the cutting unit 31, operate the cutters 313 and 314 of the cutting unit 31 at appropriate timings so that the recording medium P is cut at predetermined positions indicated in the print job (step S110), and eject the cut sheets into the sheet tray 32 (step S111). This acquires multiple recording sheets each having an appropriately formed normal image Im. After the completion of step S111, the CPU 41 ends the image forming process.

If an uneven color spot E is detected in any of the test patterns 60 (YES in step S104), the CPU 41 determines whether the normal images Im are appropriately formed (step S105) (determining step). If a test pattern 60 without an uneven color spot E is detected, the CPU 41 determines that a normal image Im is appropriately formed. In specific, the CPU 41 determines the normal image Im corresponding to the test pattern 60 without an uneven color spot E to be appropriately formed.

If there is an appropriately formed normal image (YES in step S105), the CPU 41 outputs control signals to the conveyer driver 51 and the cutting unit 31 so that the recording medium P is cut by the cutting unit 31 at predetermined positions indicated in the print job (step S106) and ejected to the sheet tray 32 (step S107). Alternatively, in step S107, multiple sheet trays 32 may be provided so that the recording sheets having appropriately formed normal images Im and the recording sheets having normal images Im having unsatisfactory quality may be ejected to different sheet trays 32.

If appropriately formed normal images Im are not determined in step S105 (NO in step S105), the CPU 41 causes the recording medium P to be ejected to the sheet tray 32 without cutting (step S107).

The CPU 41 establishes the parameters on the next image forming process on the basis of the result of step S105 (step S108). In detail, the CPU 41 generates a print job instructing the normal image Im determined to have unsatisfactory quality among the formed normal images Im to be re-formed in the next image forming process and stores the print job in the storage 44. Alternatively, the normal image Im determined to have unsatisfactory quality may be re-formed in an image forming process carried out after the next image forming process.

After the completion of step S108, the CPU 41 carries out a color-unevenness compensation process (step S109).

Figure 7:
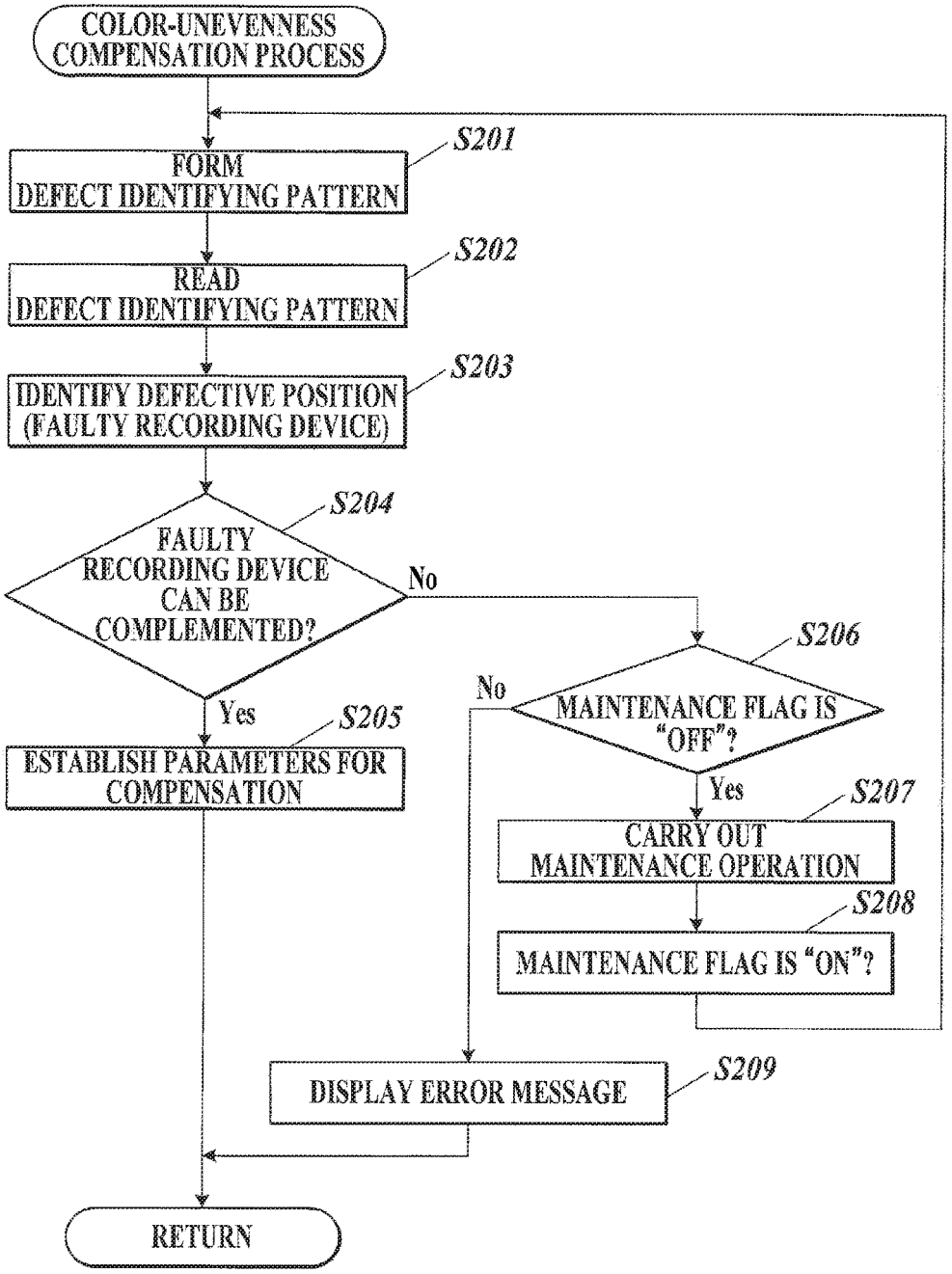
FIG. 7 is a flow chart illustrating the control procedure in a color unevenness compensation process.

FIG. 7 is a flow chart illustrating the control process for the color-unevenness compensation process.

At the start of the color-unevenness compensation process, the CPU 41 instructs the head unit 24 to form defect identifying patterns for identifying a faulty recording device on the recording medium P (step S201). In detail, the CPU 41 sends test image data on the defect identifying patterns to the recording-head driver 241 in accordance with the rotation of the conveyor drum 21, to form the defect identifying patterns on the recording medium P.

The CPU 41 instructs the image reader 26 to repeatedly read the defect identifying patterns on the recording medium P at appropriate intervals while the recording medium P is conveyed by the conveyor drum 21, acquires imaging data, and stores this data in the storage 44 (step S202).

The CPU 41 identifies the faulty recording device on the basis of a defect detected in the defect identifying patterns (step S203).

The CPU 41 determines whether the recording devices 243 in the vicinity of the faulty recording device can compensate for the reduced volume of ink ejected from the identified faulty recording device (step S204). If the compensation is possible (YES in step S204), the CPU 41 establishes the compensation parameters for adjusting the volume of ink ejected from the recording devices 243 in the vicinity of the faulty recording device (step S205). In detail, the CPU 41 corrects the image data on the normal images and the test image data on the test patterns 60 to be formed in the next image forming process, so that ink is not ejected from the faulty recording device and the volume of ink to be ejected from the recording devices 243 in the vicinity of the faulty recording device is increased in proportion to the volume of ink corresponding to the faulty recording device. After the completion of step S205, the CPU 41 ends the color-unevenness compensation process. In the case where the next image forming process is started after the color-unevenness compensation process, the CPU 41 adjusts the volume of ink to be ejected from the recording devices 243 during image forming process on the basis of the compensation parameters.

If the recording devices 243 in the vicinity of the faulty recording device cannot compensate for the ink that should be ejected from the faulty recording device (NO in step S204), the CPU 41 determines whether the maintenance flag indicates "OFF" (step S206).

If the maintenance flag indicates "OFF" (YES in step S206), the CPU 41 instructs the maintenance unit 52 to carry out a maintenance operation (step S207). After the completion of the maintenance operation, the CPU 41 sets the maintenance flag to "ON" (step S208). After the completion of step S208, the CPU 41 carries out step S201.

If the maintenance flag indicates "ON" in step S206 (NO in step S206), the CPU 41 instructs the operating/display unit 53 to display a predetermined error message (step S209). If the maintenance flag indicates "ON" in step S206, the faulty recording device cannot be complemented because it remains even after the maintenance operation (step S207). Thus, an error message is displayed to promote operations other than the maintenance operation, such as replacement of the head unit 24. The display of a message by the operating/display unit 53 may be substituted by, for example, illumination with a lamp to indicate an error, a predetermined sound alarm, or an email message sent to a predetermined email address to notify the error to the user.

After completion of step S209, the CPU 41 ends the color-unevenness compensation process.

As described above, the inkjet recorder 1 according to this embodiment includes a head unit 24 ejecting ink onto a recording medium P in accordance with the ink ejecting operation of a plurality of recording devices 243; a CPU 41 or image-formation controlling means instructing the head unit 24 to form a combined image including multiple normal images Im and test patterns 60 laid out in one recording area of the recording medium P; and an image reader 26 reading the images formed on the recording medium P. The CPU 41 detects ink ejection failure of the recording devices 243 on the basis of the test patterns 60 read by the image reader 26 (failure detecting means) and determines the quality of the normal images Im on the basis of the detected results of ink ejection failure and the positional data on images in the combined image (determining means). Such a configuration can determine the quality of the normal images Im on the basis of the positions of the images in the combined image corresponding to the results of reading the test patterns 60 of the combined image on the recording medium P. Thus, the quality of each of the normal images Im can be readily and appropriately determined.

The inkjet recorder 1 includes a conveyor drum 21 shifting the recording medium P relative to the head unit 24. The CPU 41 instructs the head unit 24 to eject ink onto the recording medium P relatively shifting in a predetermined shift direction, to form a combined image including test patterns 60 (image-formation controlling means). The test patterns 60 are formed such that the length of the test patterns 60 in the width direction is equal to the length of the quality determination areas of the normal images Im corresponding to the test patterns 60 in the width direction orthogonal to the predetermined shift direction, where the quality determination areas are targets of determination of the image quality. The CPU 41 determines the quality of the normal images Im on the basis of whether the CPU 41 as the failure detecting means detects an ink ejection failure on the basis of the results of reading the test patterns 60 corresponding to the normal images Im by the image reader 26 (determining means). In this way, the quality of the normal images Im can be readily and appropriately determined on the basis of whether an uneven color spot E indicating ink ejection failure is detected in the test patterns 60 corresponding to the normal images Im.

The CPU 41 instructs the head unit 24 to form test patterns 60 corresponding to the normal images Im (image-formation controlling means). In this way, the quality of each of the normal images Im can be independently determined.

The CPU 41 instructs the head unit 24 to form the test patterns 60 corresponding to the normal images Im upstream of the normal images Im in the predetermined shift direction of the recording medium P relative to the head unit 24 so that ejection of ink for the formation of the test patterns 60 is delayed relative to that for the formation of the normal images Im (image-formation controlling means). In this way, even if ink ejection failure occurs after the formation of a normal image Im, the ink ejection failure can be detected and thereby the normal image Im can be determined to have unsatisfactory quality. Thus, the quality of the normal image Im can be more appropriately determined.

In the case where the normal images Im are formed at different positions in the predetermined shift direction, the CPU 41 instructs the head unit 24 to form a test pattern 60 corresponding to one of the normal images Im downstream of all the other normal images Im formed upstream of the one normal image Im (image-formation controlling means). If ink ejection failure occurs during formation of images on the recording medium P, such a configuration determines the satisfactory quality of the normal images Im corresponding to the test patterns 60 completed before the ink ejection failure. Thus, the quality of the normal images Im can be more appropriately determined.

The quality determination areas are defined by the outlines of the normal images Im. Such a configuration can determine the quality of the normal images Im on the basis of whether all of the quality determination areas of the normal images Im are appropriately formed.

The normal images Im on the recording medium P determined to have unsatisfactory quality are appropriately re-formed by the head unit 24 on another recording medium P under the control of the CPU 41 (image-formation controlling means). Such selective formation of a normal image Im determined to have unsatisfactory quality on another recording medium P enables appropriate formation of the normal image Im while preventing excess consumption of ink and recording media P.

If multiple identical normal images Im on the recording medium P are determined to have unsatisfactory quality, the CPU 41 instructs the head unit 24 to re-form the same number of normal images Im as those having unsatisfactory quality on another recording medium P (image-formation controlling means). Formation of the same number of identical normal images Im as those having unsatisfactory quality on another recording medium P enables appropriate formation of the normal images Im while preventing excess consumption of ink and recording media P.

If ink ejection failure is detected, the CPU 41 instructs the head unit 24 to form defect identifying patterns for identifying a faulty recording device involving the ink ejection failure on the recording medium P (image-formation controlling means) and identifies the faulty recording device on the basis of the defect identifying patterns read by the image reader 26 (faulty-recording-device identifying means). If the faulty recording device is identified, the CPU 41 instructs the head unit 24 to form a combined image through compensation of the faulty recording device by adjusting the recording operations of the faulty recording device and the recording devices 243 in the vicinity of the faulty recording device. Such a configuration can identify the faulty recording device causing unsatisfactory quality of the normal image Im. Moreover, the normal image Im having unsatisfactory quality can be formed with satisfactory quality. Formation of only the normal image Im having unsatisfactory quality on another recording medium P can reduce the consumption of ink and recording media P.

If a faulty recording device is identified, the CPU 41 adjusts the ink ejecting operation by the faulty recording device and the recording devices in the vicinity of the faulty recording device and corrects the image data on the combined image so that the ink ejection failure of the faulty recording device is complemented (correction means). In this way, a combined image having satisfactory quality can be formed even in the presence of a faulty recording device.

The inkjet recorder 1 includes a maintenance unit 52 carrying out a maintenance operation that recovers the faulty recording devices 243 that are recoverable to a normal ink ejection state. If the ink ejection failure of the detected recording devices 243 satisfies a predetermined condition of a reduction in image quality, the CPU 41 instructs the maintenance unit 52 to start the maintenance operation (recovery controlling means). In this way, the faulty recording device causing unsatisfactory quality of the normal image Im is recovered to a normal state, and a normal image Im is more likely to be appropriately formed during subsequent image forming processes.

The CPU 41 instructs the head unit 24 to re-form after the maintenance operation the normal images Im formed on a recording medium P and determined to have unsatisfactory quality before start of the maintenance operation (image-formation controlling means). In this way, the normal image Im having unsatisfactory quality can be formed with satisfactory quality. Formation of only the normal image Im having unsatisfactory quality on another recording medium P can reduce excessive consumption of ink and recording media P.

The method of determining quality according to this embodiment determines the quality of an image formed by the inkjet recorder 1 including a head unit 24 ejecting ink onto a recording medium P in accordance with ink ejecting operations of recording devices 243, the method including an image forming step by the head unit 24 forming a combined image including multiple normal images Im and test patterns 60 laid out in one recording area of the recording medium P; a failure detecting step of detecting failure of a recording operation by a recording device 243 based on the test patterns 60 read by an image reader 26 reading images; and a determining step determining the quality of the normal images Im based on the results of the detection of the recording operation failure in the failure detecting step and positional information on the images in the combined image. In this way, the quality of each of the normal images Im is determined on the basis of the results of reading the test patterns 60 of the combined image on the recording medium P and the position of the images in the combined image. Thus, the quality of the normal images Im can be readily and appropriately determined.

First Modification

A first modification of the embodiment described above will now be described. The test patterns 60 according to the first modification differ from those according to the embodiment described above. The following description will be focused on the differences from the embodiment described above.

Figure 8:
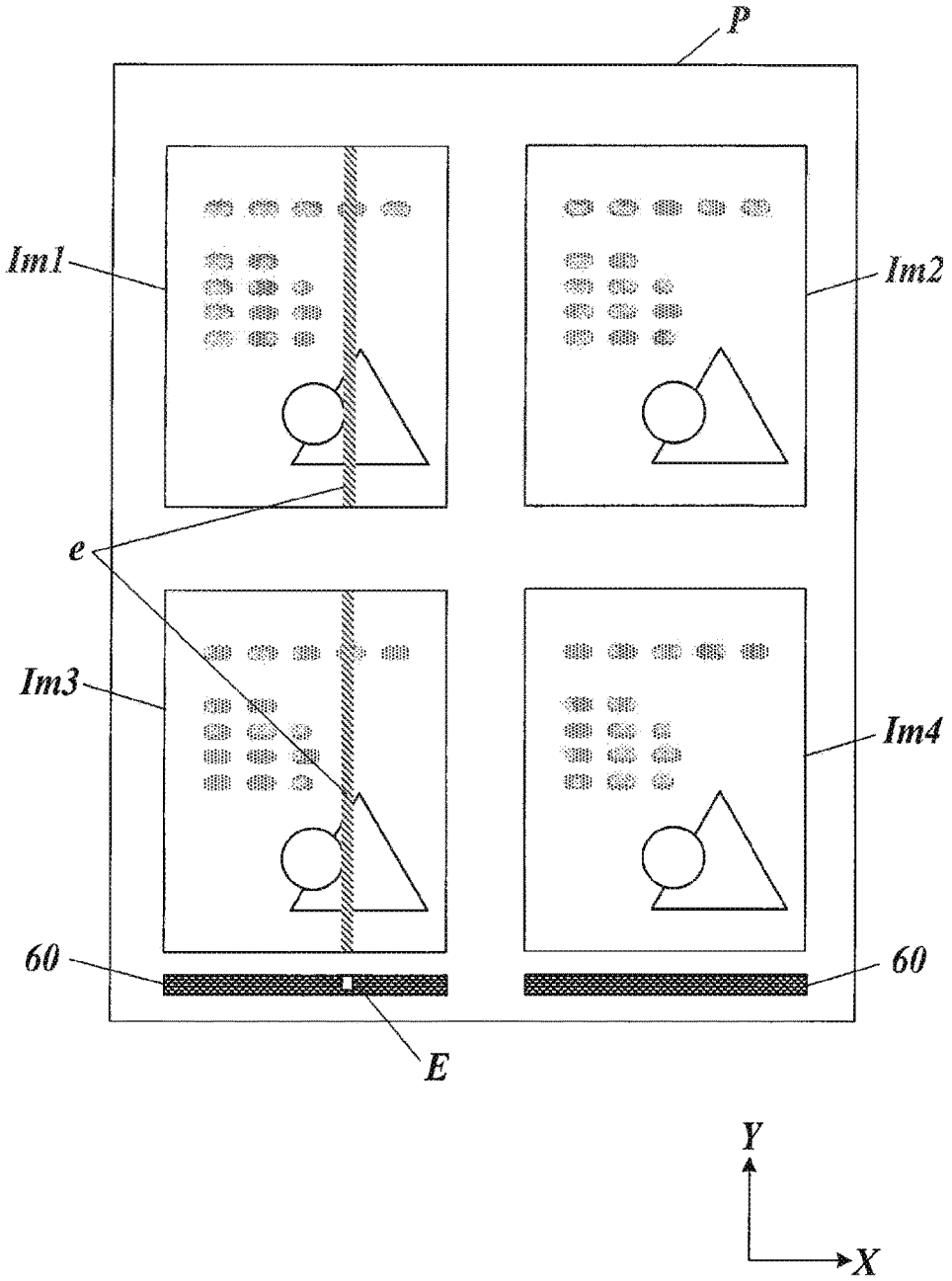
FIG. 8 illustrates example normal images and example test patterns according to a first modification.

FIG. 8 illustrates example normal images Im and example test patterns 60 according to the first modification.

FIG. 8 illustrates a test pattern 60 in the margin on the −Y direction side of the normal image Im3, the test pattern 60 having a length in the X direction equal to the length of the normal images Im1 and Im3 adjacent in the Y direction. Similarly, another test pattern 60 is provided in the margin on the −Y direction side of the normal image Im4, the test pattern 60 having a length in the X direction equal to the length of the normal images Im2 and Im4 adjacent in the Y direction. An uneven color spot E appears in the test pattern 60 on the left of FIG. 8. Unsatisfactory regions e appear in the normal images Im1 and Im3 corresponding to the test pattern 60 including the uneven color spot E on the left of FIG. 8. In this case, the normal images Im1 and Im3 corresponding to the test pattern 60 including the uneven color spot E are determined to have unsatisfactory quality, whereas the normal images Im2 and Im4 corresponding to the test pattern 60 without the uneven color spot E are determined to have satisfactory quality.

Second Modification

A second modification of the embodiment described above will now be described. The normal images Im and the test patterns 60 according to the second modification differ from those according to the embodiment described above. The following description will be focused on the differences from the embodiment described above.

Figure 9:
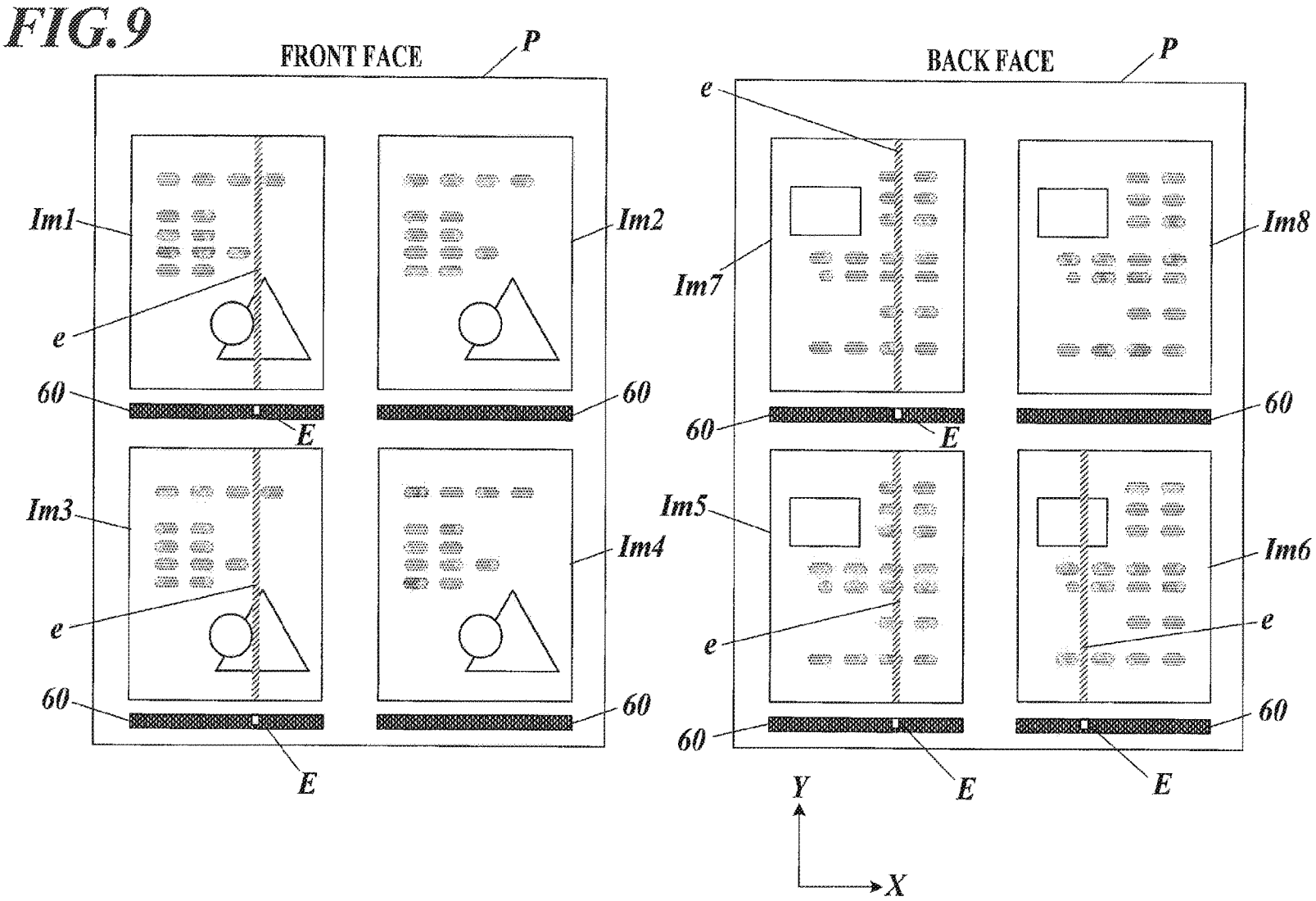
FIG. 9 illustrates example normal images and example test patterns according to a second modification.

FIG. 9 illustrates example normal images Im and example test patterns 60 according to the second modification.

FIG. 9 illustrates normal images Im1 to Im4 and test patterns 60 corresponding to the normal images Im1 to Im4 on the front face of a recording medium P, and normal images Im5 to Im8 and test patterns 60 corresponding to the normal images Im5 to Im8 on the back face of the recording medium P. In the case where images are to be formed on the front and back faces of the recording medium P, images are formed on the front face of the recording medium P and then the test patterns 60 on the front face are read to detect uneven color spots E. The front and back of the recording medium P are then inverted by the inversion unit 28 and held on the conveyor drum 21, to form images on the back face. The test patterns 60 on the back face are read to detect uneven color spots E. The outlines of the normal images Im on the front and back faces of the recording medium P, as illustrated in FIG. 9, are cut to obtain recording sheets each having one normal image Im on each of the front and back faces. The recording medium P illustrated in FIG. 9 is cut into a recording sheet having the normal images Im1 and Im5 on the front and back faces, respectively, a recording sheet having the normal images Im2 and Im6 on the front and back faces, respectively, a recording sheet having normal images Im3 and Im7 on the front and back faces, respectively, and a recording sheet having normal images Im4 and Im8 on the front and back faces, respectively.

In FIG. 9, uneven color spots E appear in the test patterns 60 corresponding to normal images Im1, Im3, Im5, Im6, and Im7, and unsatisfactory regions e appear in the normal images Im1, Im3, Im5, Im6, and Im7. In this case, the normal images Im4 and Im8 having satisfactory quality are formed in the respective areas on the front and back faces of the recording medium P. The outlines of the normal images Im4 and Im8 can be cut to obtain a recording sheet having the normal images Im4 and Im8 having satisfactory quality on the front and back faces, respectively. As described above, even if a portion of the front face of the recording medium P has normal images Im having unsatisfactory quality, a recording sheet having normal images Im having satisfactory quality on the front and back faces is acquired after cutting, depending on the result of determination of the quality of the normal images Im on the back face of the recording medium P.

On the contrary, the other recording sheets of the recording medium P have normal images Im having unsatisfactory regions e on at least one of the front and back faces. Thus, the print job of the next image forming process (step S108 described above) includes parameters for forming the normal images Im1 to Im3 on the front face and the normal images Im5 to Im7 on the back face at corresponding positions. With reference to FIG. 9, the normal image Im2 on the front face is appropriately formed, whereas the corresponding normal image Im6 on the back face has unsatisfactory regions e. Thus, in the next image forming process, the normal images Im2 is re-formed on the front face of the recording medium P at a position corresponding to the normal image Im6 on the back face. In the case where only the normal image Im on the back face among the normal images Im on the front and back faces at corresponding positions has unsatisfactory quality, the corresponding normal image Im on the front face is re-formed in a subsequent image forming process, regardless of the quality of the normal image Im on the front face.

Thus, the quality of the normal images Im on both the front and back faces may be determined through detection of uneven color spots E in the test patterns 60 only on the back face. However, the uneven color spots E in the test patterns 60 is detected independently on the front and back faces so that the normal images Im on the front face are appropriately determined to have unsatisfactory quality even if the ink ejection failure that occurs during image formation of the front face is recovered during image formation of the back face.

Third Modification

The third modification of the embodiment described above will now be described. The test pattern 60 according to the third modification differs from the test patterns 60 according to the embodiment described above. The following description will be focused on the differences from the embodiment described above.

Figure 10:
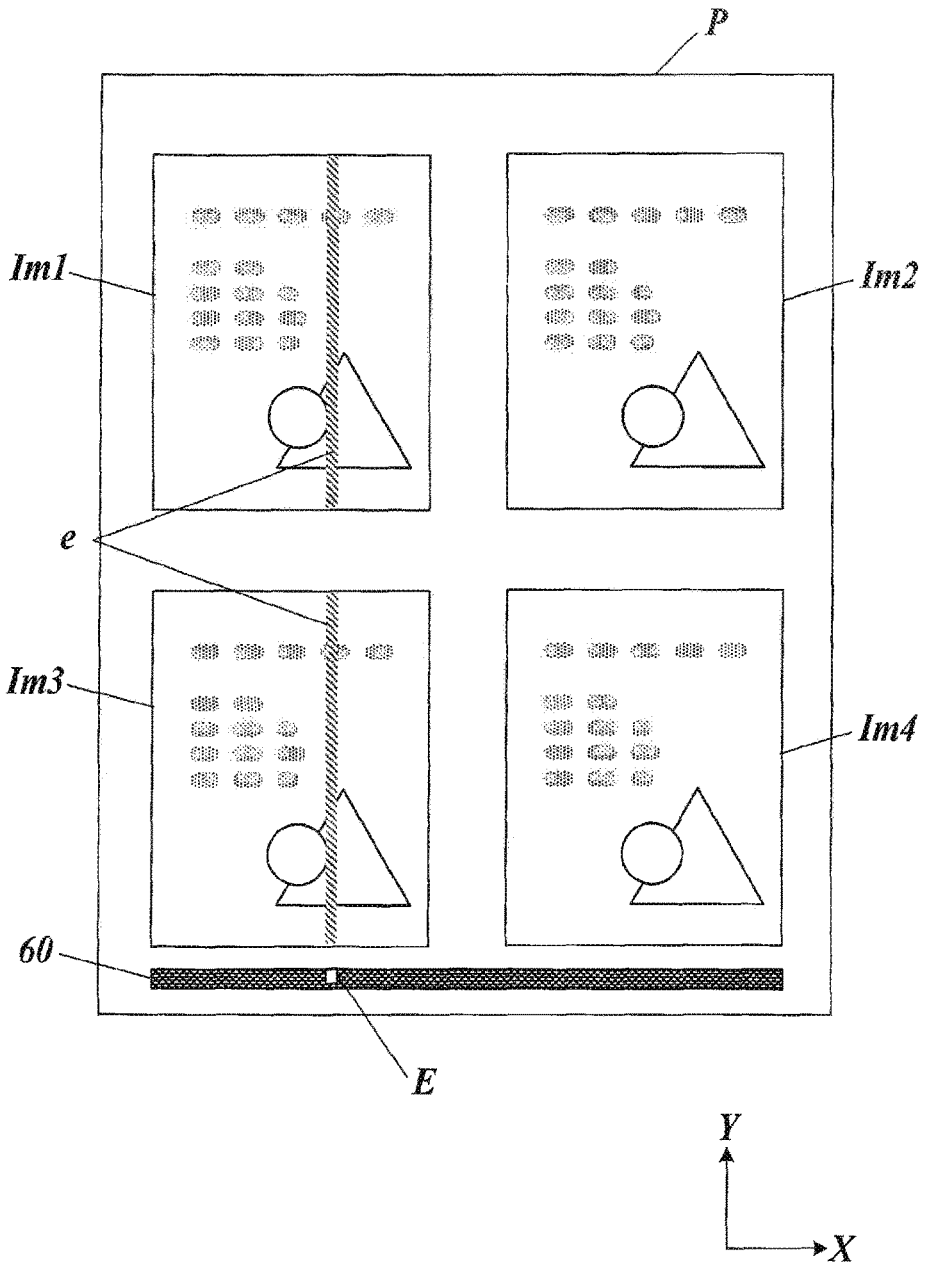
FIG. 10 illustrates example normal images and example test patterns according to a third modification.

FIG. 10 illustrates example normal images Im and an example test pattern 60 according to the third modification.

FIG. 10 illustrates a test pattern 60 in the margin on the −Y direction side of normal images Im1 to Im4 (upstream of the conveying direction). The test pattern 60 has a length in the X direction equal to the length of the area including the normal images Im1 to Im4 in the X direction.

The quality of the normal images Im according to the third modification is determined on the basis of the correspondence between the position in the X direction of an uneven color spot E indicated in the image-capturing data on the test pattern 60 and the length in the X direction (quality determination areas) of the normal images Im1 to Im4 obtained from the positional data of the print job. In FIG. 10, the position of the uneven color spot E in the test pattern 60 in the X direction is included in the length of the normal images Im1 and Im3 in the X direction. Thus, the normal images Im1 and Im3 among the normal images Im1 to Im4 are determined to have unsatisfactory quality.

FIG. 10 illustrates a single test pattern 60 on a single recording medium P. Alternatively, several test patterns 60 may be formed at different positions in the Y direction. In detail, test patterns 60 may be formed in the margin on the −Y direction side of the normal images Im1 and Im2 and have a length equal to or larger than the length of the normal images Im1 and Im2 in the X direction and in the margin on the −Y direction side of the normal images Im3 and Im4 and have a length equal to or larger than the length of the normal images Im3 and Im4 in the X direction.

The inkjet recorder 1 according to the third modification includes a conveyor drum 21 shifting a recording medium P relative to a head unit 24; and a storage 44 storing positional data indicating the positions of quality determination areas corresponding to normal images Im in a combined image. A CPU 41 forms a combined image by instructing the head unit 24 to eject ink onto the recording medium P relatively shifting in a predetermined shift direction. Test patterns 60 extend in the width direction orthogonal to the predetermined shift direction in a length that at least includes the lengths of the quality determination areas of the normal images Im (image-formation controlling means). The CPU 41 determines the quality of each of the normal images Im on the basis of the position of the faulty recording device corresponding to the detected ink ejection failure and the positional data (determining means). In this way, the test patterns 60 can be formed in a predetermined area having a length in the width direction that includes the length of the quality determination area of each normal image Im in the width direction. Thus, the length of the test patterns 60 can be more freely selected. The length of test patterns 60 in the shift direction can be made smaller than the test patterns 60 formed corresponding to each normal image Im overlapping in the width direction of the normal images Im.

The CPU 41 instructs the head unit 24 to form the test patterns 60 upstream of the normal images Im in the predetermined shift direction of the recording medium P relative to the head unit 24 where the timing of ejection of ink for the formation of the test patterns 60 is delayed relative to that for the formation of the normal images Im (image-formation controlling means). Even if ink ejection failure occurs after the formation of a normal image Im, the ink ejection failure can be detected and thereby the normal image Im can be determined to have unsatisfactory quality. Thus, the quality of the normal image Im can be more appropriately determined.

The CPU 41 instructs the head unit 24 to form multiple test patterns 60 on a recording medium P (image-formation controlling means), to form at least one of the normal images Im upstream of the test pattern 60 corresponding to another one of the normal images Im in a combined image. If ink ejection failure occurs during image formation on a recording medium P, such a configuration can determine the normal images Im corresponding to the test patterns 60 completed before the ink ejection failure to have satisfactory quality. Thus, the quality of the normal images Im can be more appropriately determined.

Fourth Modification

The fourth modification of the embodiment described above will now be described. The normal images Im according to the fourth modification differ from those according to the embodiment described above. The following description will be focused on the differences from the embodiment described above.

Figure 11:
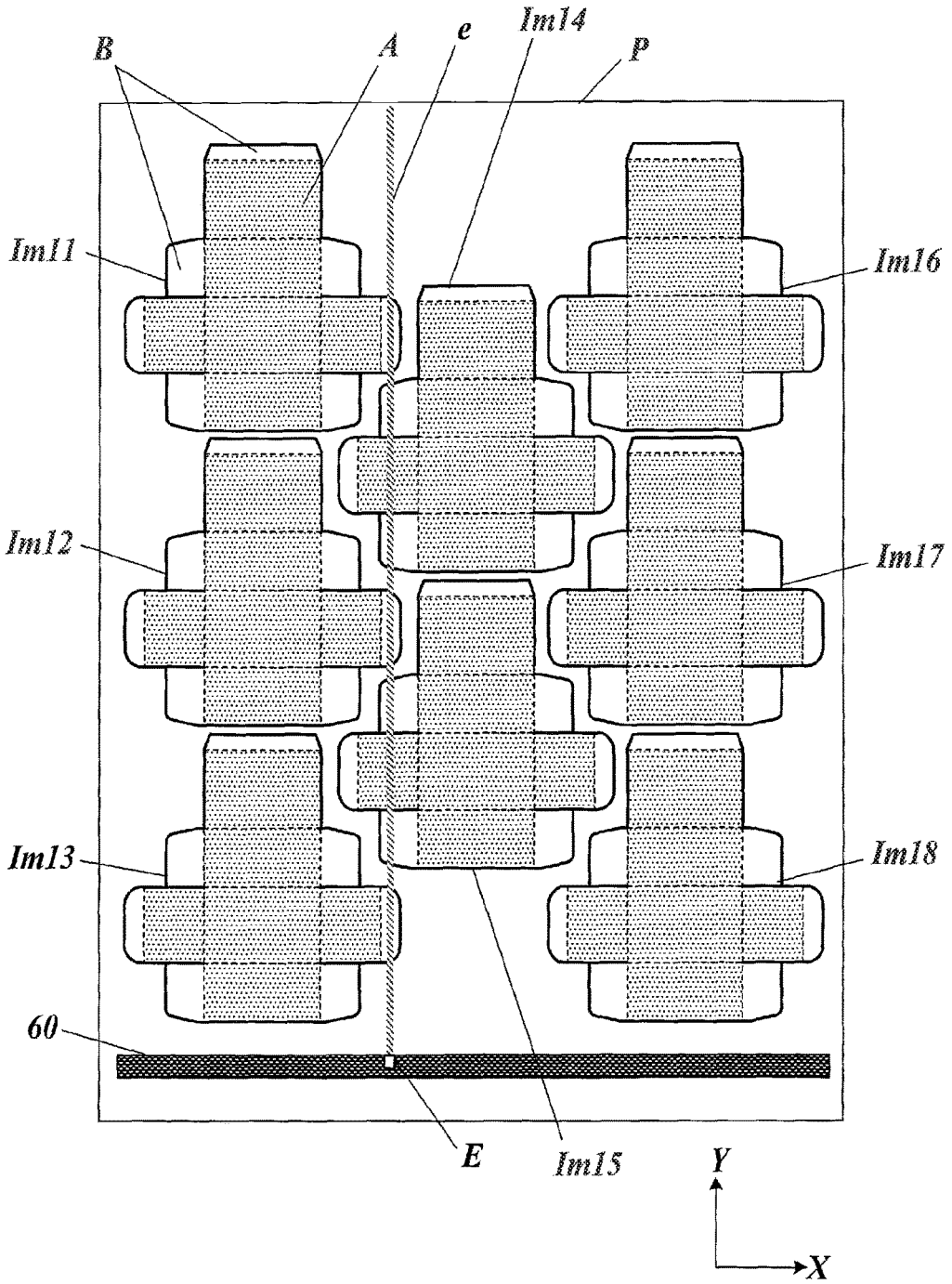
FIG. 11 illustrates example normal images and example test patterns according to a fourth modification.

FIG. 11 illustrates example normal images Im11 to Im18 and example test patterns 60 according to the fourth modification.

The normal images Im11 to Im18 are images of products or developments of cubic product packages, as illustrated in FIG. 11. The eight normal images Im11 to Im18 are laid out such that the maximum number of normal images are disposed in the recording medium P. The normal images Im11 to Im18 each constitute the outer faces of a cube when assembled. The normal images Im11 to Im18 each include package faces A serving as the external faces of the product when put to the intended use of the product and margins B that are folded inward of the cube when assembled and invisible on the external faces of the product. The margins B are glued to other faces, if necessary. Alternatively, the normal images Im according to the fourth modification may be images constituting a portion of a product.

The normal images Im11 to Im18 can be used as product packages if the images on at least the package faces A are appropriately formed. Thus, the package faces A of the normal images Im are assigned as quality determination areas in the positional data of the print job. The quality of the normal images Im is determined on the basis of the correspondence between the position of an uneven color spot E detected in the test pattern 60 in the X direction and the length of the package faces A of the normal images Im11 to Im18 in the X direction obtained from the positional data of the print job. In FIG. 11, the position of the uneven color spot E detected in the test pattern 60 in the X direction is included in the X direction of the package faces A of the normal images Im14 and Im15. Thus, the normal images Im14 and Im15 are determined to have unsatisfactory quality. Although the position of the uneven color spot E in the X direction is included in the X direction of the margins B of the normal images Im11 to Im13, the normal images Im11 to Im13 are determined to have satisfactory quality because the quality of the margins B is not to be determined.

If necessary, the package faces A and the margins B of the normal images Im may be determined to be quality determination areas. In such a case, the normal images Im11 to Im15 among the normal images Im in FIG. 11 are determined to have unsatisfactory quality.

In the inkjet recorder 1 according to the fourth modification, the normal images Im each constitute at least a portion of a product. The quality determination areas of the normal images Im are visible on the external faces of the product put to the intended use of the product. In this way, the normal images Im can be prevented from being incorrectly determined to have unsatisfactory quality due to unsatisfactory quality of the portions of the normal images Im not visible on the external faces of the product. Thus, the quality of the normal images Im can be more appropriately determined, and excess consumption of ink and recording media P can be prevented.

Besides the embodiment and the modifications described above, the present invention may include various other modifications.

For example, in the embodiment and the modifications described above, test images are provided in the form of halftone images or test patterns 60 together with normal images Im. The present invention may include any other test images. For example, the test images may be provided in the form of defect identifying patterns and read by the image reader 26, thereby determining the presence of a faulty recording device. In such a case, the faulty recording device may be identified on the basis of the read results.

In the embodiment and the modifications described above, multiple normal images Im are formed on the basis of the image data stored in the storage 44, and the test patterns 60 are formed on the basis of the test image data stored in the ROM 43. The normal images Im and the test patterns 60 may be formed on the basis of any other data. For example, combined image data on a combined image including multiple normal images Im and test patterns 60 may be preliminarily prepared, and the normal images Im and the test patterns 60 may be formed on the basis of the combined image data.

In the embodiment and the modifications described above, the recording medium P is a cut paper sheet. Alternatively, the recording medium P may be any other medium such as a continuous form or a sheet transported through roll-to-roll feeding. In such a case, normal images are laid out in recording areas set on a recording medium.

In the embodiment and the modifications described above, a color-unevenness compensation process is carried out if a faulty recording device is detected and then a re-formation operation is carried out. The processes after detection of a faulty recording device is not limited thereto. For example, if a faulty recording device is detected and normal images can be formed with normal practical recording devices 243 other than the faulty recording device, the re-formation operation may be carried out by the normal practical recording devices 243 without color-unevenness compensation.

In the embodiment and the modifications described above, the inkjet recorder 1 includes an image reader 26. In place of the image reader 26, an external image reader of the inkjet recorder 1 may read the normal images Im and the test patterns 60.

In the embodiment and the modifications described above, the conveyor drum 21 conveys the recording medium P. Alternatively, the recording medium P may be conveyed by any other means. For example, the present invention may be applied to an image forming apparatus including a conveying belt that shifts in accordance with the rotation of two rollers supporting the conveying belt and conveys the recording medium P.

In the embodiment and the modifications described above, the inkjet recorder 1 includes a line head including an array of recording devices 243 extending across the image area on the recording medium P in the X direction. Alternatively, the present invention may be applied to an inkjet recorder that records an image while scanning a recording head.

In the embodiment and the modifications described above, the inkjet recorder 1 is a piezoelectric inkjet recorder including image forming devices in the form of piezoelectric devices. Alternatively, any other inkjet recorder besides a piezoelectric inkjet recorder may be used. For example, the present invention may be applied to any type of image forming apparatus, such as a thermal inkjet recorder that generates bubbles in ink by heating to cause the ink to be ejected, a xerographic image forming apparatus that forms an image with toner particles or colorant on a photosensitive drum and transfers the image onto a recording medium, or a wet-electrographic-image forming apparatus that uses liquid toner in place of toner particles or colorant. An electrographic-image forming apparatus may determine the quality of normal images by reading the normal images and test images formed on a photosensitive drum before transfer to a recording medium, instead of determining the quality of the normal images by reading the normal images and test images formed on a recording medium. For example, in an electrographic-image forming apparatus including a photosensitive drum exposed by light from a LED print head, the light emitting devices of the LED print head serve as recording devices.

The embodiments described above should not be construed to limit the present invention, and the claims and other equivalents thereof are included in the scope of the invention.

INDUSTRIAL APPLICABILITY

The present invention can be used for an image forming apparatus and a method of determining quality. Although embodiments of the present invention have been described and illustrated in detail, the disclosed embodiments are made for purposes of illustration and example only and not limitation. The scope of the present invention should be interpreted by terms of the appended claims.

DESCRIPTION OF REFERENCE NUMERALS

1 inkjet recorder
2 external unit
10 sheet feeder
11 sheet tray
12 transfer unit
20 image recorder
21 conveyor drum
22 transporter
23 heater
24 head unit
241 recording-head driver
242 recording head
243 recording device
244 nozzle
25 fixing unit
26 image reader
27 delivery unit
28 inversion unit
30 post-processor
31 cutting unit
32 sheet tray
40 controller
41 CPU
42 RAM
43 ROM
44 storage
51 conveyer driver
52 maintenance unit
53 operating/display unit
54 input/output interface
55 bus
60 test pattern
Im, Im1 to Im8, Im11 to Im18 normal images
P recording medium

The invention claimed is:

1. An image forming apparatus comprising:

a recorder applying a colorant to a recording medium in accordance with a recording operation of a plurality of recording devices;

an image-formation controller instructing the recorder to form a combined image including a plurality of normal images and a test image on the recording medium, the normal image being laid out in a recording area on the recording medium;

a reader reading the images formed on the recording medium;

a failure detector detecting a recording operation failure of any of the recording devices based on the test image read by the reader; and a determiner determining the quality of each of the normal images based on the detected result of the recording operation failure by the failure detector and positional information on the images in the combined image.

2. The image forming apparatus according to claim 1, further comprising:

a shifting unit shifting the recording medium relative to the recorder in one or two or more shift directions, wherein, the image-formation controller instructs the recorder to form the combined image including the test image, which includes a plurality of test images, by applying the colorant to the recording medium relatively shifting in a predetermined shift direction, the test images are formed so that a length in a width direction of the test image corresponding to the normal image is equal to the length in the width direction of quality determination areas of the normal images, the quality determination areas being areas of which the quality is to be determined, the width direction being a direction orthogonal to the predetermined shift direction, and the determiner determines the quality of each of the normal images based on whether the failure detector detected a recording operation failure from the results of reading the test images corresponding to the normal images by the reader.

3. The image forming apparatus according to claim 2, wherein the image-formation controller instructs the recorder to form the normal images and the test images corresponding to the normal images.

4. The image forming apparatus according to claim 2, wherein the image-formation controller instructs the recorder to form the test images corresponding to the normal images upstream of the normal images in the predetermined shift direction of the recording medium relative to the recorder such that the timing of the application of the colorant for the formation of the test images is delayed relative to the timing of the application of the colorant for the formation of the normal images.

5. The image forming apparatus according to claim 4, wherein if the normal images are formed at different positions in the predetermined shift direction, the image-formation controller instructs the recorder to form the test image corresponding to one of the normal images downstream of the other normal images formed upstream of the one normal image.

6. The image forming apparatus according to claim 2, wherein the quality determination areas are defined by the outlines of the normal images.

7. The image forming apparatus according to claim 2, wherein, each of the normal images comprises at least a portion of a product, and the quality determination areas are portions of the normal images visible on the external faces of the products put to the intended use of the product.

8. The image forming apparatus according to claim 1, further comprising:

a shifting unit shifting the recording medium relative to the recorder in one or two or more shift directions; and a storage storing information on the positions of the quality determination areas of the normal images in the combined image, the quality determination areas being areas of which the quality is to be determined, wherein, the image-formation controller instructs the recorder to form the combined image on the recording medium by applying the colorant on the recording medium shifting relative to the recording means in a predetermined shift direction, the test image has a length that at least includes the length of the quality determination areas of the normal images in a width direction orthogonal to the predetermined shift direction, the quality determination areas being areas of which the quality is to be determined, and the determiner determines the quality of each of the normal images based on the position of a faulty recording device involving the recording operation failure detected by the failure detector and information on the quality determination areas.

9. The image forming apparatus according to claim 8, wherein the image-formation controller instructs the recorder to form the test image upstream of the normal images in the predetermined shift direction of the recording medium relative to the recorder such that the timing of the application of the colorant for the formation of the test image is delayed relative to the timing of the application of the colorant for the formation of the normal images.

10. The image forming apparatus according to claim 9, wherein, the image-formation controller instructs the recorder to form a plurality of test images on the recording medium, and at least one of the normal images is formed upstream of one of the test images corresponding to another one of the normal images in the combined image.

11. The image forming apparatus according to claim 1, wherein the image-formation controller instructs the recorder to carry out a re-formation operation of re-forming a normal image on the recording medium determined to have unsatisfactory quality by the determiner with satisfactory quality on another recording medium.

12. The image forming apparatus according to claim 11, wherein if the determiner determines multiple identical normal images on the recording medium to have unsatisfactory quality, the image-formation controller instructs the recorder to carry out the re-formation operation of re-forming the same number of normal images as the normal images having unsatisfactory quality on another recording medium.

13. The image forming apparatus according to claim 11, further comprising:

a recovery unit carrying out a recovery operation to recover a recording device in a state of recording operation failure to a normal state, the recording device being recoverable to the normal state, and a recovery controller instructing the recovery unit to start the recovery operation if the recording operation failure of the recording device detected by the failure detector satisfies a predetermined condition of a reduction in the quality of image, wherein, the image-formation controller instructs the recorder to carry out the re-formation operation of a normal image determined to have unsatisfactory quality by the determiner before the recovery operation, after the recovery operation.

14. The image forming apparatus according to claim 1, further comprising:

a faulty-recording-device identifying unit identifying a faulty recording device based on an identifying image read by the reader, wherein the image-formation controller instructs the recorder to form on the recording medium the identifying image for identifying the faulty recording device involving the recording operation failure detected by the failure detector, and the image-formation controller instructs the recorder to form the combined image through compensation of the faulty recording device involving the recording operation failure by adjusting the recording operations of the faulty recording device and the recording devices in the vicinity of the faulty recording device when the faulty recording device is identified.

15. The image forming apparatus according to claim 14, further comprising a correcting unit adjusting the recording operation by the faulty recording device and the recording devices in the vicinity of the faulty recording device and correcting image data on the combined image to complement the recording operation failure of the faulty recording device when the faulty recording device is identified.

16. The image forming apparatus according to claim 1, further comprising:

a recovery unit carrying out a recovery operation to recover a recording device in a state of recording operation failure to a normal state, the recording device being recoverable to the normal state, and a recovery controller instructing the recovery unit to start the recovery operation if the recording operation failure of the recording device detected by the failure detector satisfies a predetermined condition of a reduction in the quality of the image.

17. A method of determining quality of an image formed by an image forming apparatus comprising a recorder applying a colorant to a recording medium in accordance with a recording operation of a plurality of recording devices, the method comprising:

instructing the recorder to form a combined image including a plurality of normal images and a test image on the recording medium, the normal images and the test image being laid out in a recording area on the recording medium;

detecting a recording operation failure of any of the recording devices from the test image read by a reader reading images; and determining the quality of each of the normal images based on the detected result of the recording operation failure in the failure detecting step and positional information on the images in the combined image.

* * * * *